United States Patent [19]

Lario et al.

[11] 4,332,353

[45] Jun. 1, 1982

[54] PROCEDURE FOR MECHANICALLY RAISING THE WOOD CONTENT IN WOOD CHIPS

[75] Inventors: Heikki Lario, Lahti; Matti Haimila, Kartano, both of Finland

[73] Assignee: Kone Osakeyhito, Helsinki, Finland

[21] Appl. No.: 105,542

[22] Filed: Dec. 20, 1979

[30] Foreign Application Priority Data

Dec. 23, 1978 [DE] Fed. Rep. of Germany ..... 2856020

[51] Int. Cl.[3] ..... B02C 17/00

[52] U.S. Cl. ..... 241/14; 241/24; 241/28; 241/29; 241/30

[58] Field of Search ..... 241/152 A, 29, 14, 24, 241/27, 30, 78, 79, 170, 28

[56] References Cited

U.S. PATENT DOCUMENTS

| | | | |
|---|---|---|---|
| 2,437,672 | 3/1948 | Anway | 241/14 |
| 2,835,292 | 5/1958 | Berliner | 241/14 X |
| 3,070,318 | 12/1962 | Blanchard | 241/14 |
| 3,337,139 | 8/1967 | Lloyd et al. | 241/28 X |
| 3,826,433 | 7/1974 | Erickson et al. | 241/14 |

*Primary Examiner*—Mark Rosenbaum

*Attorney, Agent, or Firm*—Martin Smolowitz

[57] ABSTRACT

Procedure for mechanically raising the wood content of wood chips (1), or for mechanically purifying the wood chips of bark and greenstuff matter and of other fines such as sand, by separation sifting. Prior to the separation sifting (5) the bark and greenstuff matter are detached from the wood chips by grinding (3).

3 Claims, 1 Drawing Figure

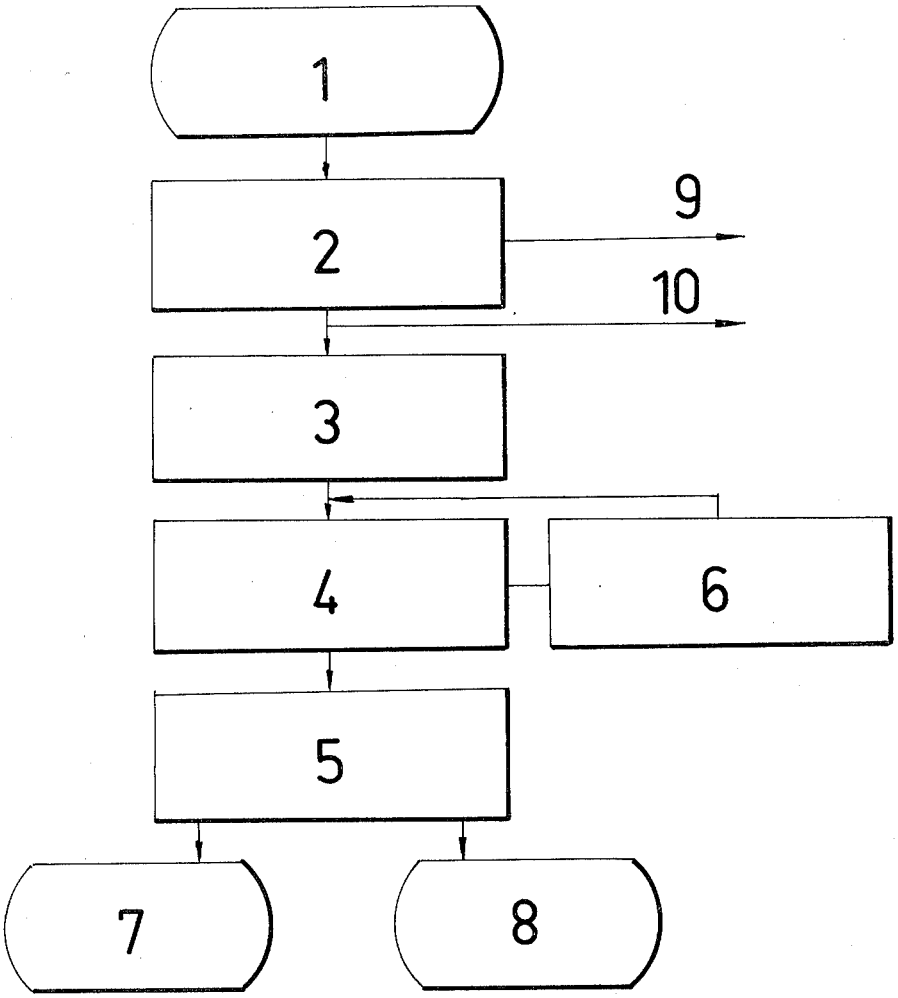
1
2
9
10
3
4
6
5
7
8

PROCEDURE FOR MECHANICALLY RAISING THE WOOD CONTENT IN WOOD CHIPS

The present invention concerns a procedure for mechanically raising the wood content of chipped wood material, that is to purify the chipped material by mechanical means of bark and green matter and of other fines such as sand, by separatory screening.

It has nowadays become increasingly necessary to utilize nature's raw material resources to the highest possible degree. This has also been done in the case of wood intended to be used in producing cellulose. It has been found that after tree felling and harvesting there often remain felling residues in the forest which contain quite much wood material appropriate for digesting. This has led to the practice of chipping down trees in their entirety above the stump cut and processing the wood chips thus obtained to cellulose by digesting.

The most serious obstacle to using chips in the cellulose pulp industry has been the high proportion of bark and greenstuff in the chips, and their sand content. The low wood content causes difficulties as well as remarkable added load, for instance in the digesting step, in the circulation of chemicals and in the washing process. Owing to these factors, the chances of employing wood chips more extensively than heretofore can be significantly increased by raising the wood content of the chipped wood.

For the barking of wood which is presented in chip form, a few procedures have been developed. In the so-called squeeze barking method, which is one of them, the chips are passed through between several pairs of rolls, whereby the pressure effect of the rolls crumbles the bark and thus detaches bark from the wood. But this procedure has its weak point therein that acceptable bark contents are only attained with high wood losses because under pressure wood is also crushed and part of the wood goes along with the bark, which is screened off.

Another procedure is based on the circumstance that wood and bark have different water absorptions. In this procedure, the chips and bark produced in the chipping process are vacuum-treated and thereafter released to float in a water tank. The wood chips tend to absorb water and to go under, while the bark particles tend to keep on floating. The submerged chips are recovered with a drag chain, and the material on the surface is skimmed off. This method has two basic shortcomings however: it implies that the bark has all come off during the chipping process and, secondly, it is not selective enough when used with different timber species.

It is possible according to a certain procedure to obtain easier detachment of bark from wood chips if the chips are stored in heaps, whereupon the chips are agitated in water and screened in wet condition. The mixing is accomplished in a pulper, where the bark is detached from the wood part and is ground fine, whereupon it is removed through the pulper's screen plate, the wood part of the chips remaining behind. In this procedure no chemicals are used and therefore it requires indeed a fairly prolonged storage of the chips with intact bark so that biological phenomena might put the bark detachment under way. This is in fact the weak point of this method in that when chips with intact bark are being kept in storage the biological activities taking place in the bark also start the decay of the wood part, and the quality of the chips deteriorates, as can be seen by impairment in paper technology characteristics of the fibres which can be made from the chips. Paper made of such chips has a tearing strength considerably inferior to that of paper made of fresh wood.

There are, furthermore, procedures which are based on the use of chemicals. The problem is then in the first place a high consumption of chemicals, and effluent problems.

The object of the present invention is to provide a procedure for raising the wood content of wood chips, that is for purifying wood chips from bark and greenstuff constituents, and which is free of the drawbacks mentioned. The invention is characterized in that prior to separatory screening, the bark and green matter are detached from the chipped wood by grinding.

The procedure of the invention presents a number of advantages, owing to which it possesses excellent chances to effect an improvement in the quality of the chipped wood. That part of the material which is not acceptable as product for use in the cellulose digesting process proper may be utilized in another way. It is a second advantage: that the capacity of the installation may be raised to be high, merely by increasing the various components of the installation. Moreover, one of the advantages is the procedure's low labour requirement. Still another advantage is the low energy consumption of the installation.

One advantageous embodiment of the invention is characterized in that the grinder treatment is carried out in dry condition. Since no water or chemicals are used there are no effluent problems, and the waste fraction retains a high calorific value.

Another embodiment of the invention is characterized in that the detachment of bark and greenstuff is effected in the grinder drum. The detaching effect is even further enhanced if the grinder drum contains suitable grinding bodies, such as balls.

Still one embodiment of the invention is characterized in that subsequent to the grinder treatment is carried out thickness sorting of the wood chips by disk sieving. A highly uniform quality is thus obtained. The particles separated in the thickness sorting step are minced with a disk chopper and are reintroduced into the process.

One embodiment of the invention is also characterized in that after thickness sorting there is separated from the wood chips by screening, the bark and green matter which was detached in the grinder treatment. Hereby the reject fraction can be separated from the wood chips.

The procedure of the invention is described in detail in the following with the aid of an example, reference being made to the attached schematic diagram.

The reference numerals in the diagram represent the following:

1—Wood chips
2—Prescreening
3—Grinding
4—Thickness sorting
5—Separation sifting
6—Comminution of thick particles
7—Bark, greenstuff, other fines
8—Product
9—Stones, oversize pieces
10—Iron objects.

To begin with the wood chips, which have 65 to 85% wood content, are screened in a disk sieve 2, this step removing from the chips the stones and other bodies 9 which are oversize or would damage the equipment. The chips are then conducted to the dry grinder drum treatment 3. In the rotating drum, by means of attrition and impact treatment with grinding bodies of appropriate shape and weight in each particular case, such as balls for instance, the bark and green matter are detached from the wood material, and at the same time the bark pieces, leaves and needles are comminuted prior to the screening taking place in two steps.

As the first step in the screening, the thickness sorting 4 of the chips is carried out. Chips with excessive thickness are here conducted to the disk chopper 6, where they are crushed to small size and returned to the thickness sorting step 4. The chip material that has passed the thickness sorting screen goes to the plane sifter 5, where separation sifting is accomplished. In this step, the bark and green matter that has been ground fine in the grinder drum treatment, as well as other fines such as sand 7, are separated from the chip material intended to be incorporated in the product proper, 8, this product presenting a wood content up to and over 95% after separation.

It is obvious to a person skilled in the art that the invention is not confined to the example presented above, and that it may be modified within the scope of the claims presented hereinbelow.

We claim:

1. An improved process for mechanically raising wood content of wood chips in a dry state, including the steps of: initially screening dry wood material in a disk sieve for removing oversize bodies therefrom; introducing said material into a grinder drum having grinder bodies, such as balls; rotating said drum with said dry wood material to thereby detach bark and green matter therefrom to yield dry wood chips; comminuting said bark and green matter; screening of said dry chips by thickness sorting; directing excessively thick chips to a disk chopper for crushing and subsequent thickness sorting; directing dry chips passing through said subsequent thickness sorting to a separation sifter; and further separating said dry chips from said bark and green matter by additional screening.

2. A method according to claim 1, including the steps of: separating wood chips by sifting the bark and green matter than has been detached and comminuted during grinder treatment.

3. A method according to claim 1, including the steps of: separating thick particles during thickness sorting, comminuting with a disk chopper and reintroducing comminuted product for separation sifting.

* * * * *